US007207567B1

(12) United States Patent
Brown

(10) Patent No.: US 7,207,567 B1
(45) Date of Patent: Apr. 24, 2007

(54) ANATOMICAL WEAPONS QUALIFICATION TARGET

(76) Inventor: Jeffrey Brown, 2316 Territorial Rd., St. Paul, MN (US) 55114

( * ) Notice: Subject to any disclaimer, the term of this patent is extended or adjusted under 35 U.S.C. 154(b) by 164 days.

(21) Appl. No.: 11/068,238

(22) Filed: Mar. 1, 2005

(51) Int. Cl.
*F41J 1/00* (2006.01)

(52) U.S. Cl. ..... 273/409

(58) Field of Classification Search ..... 273/403–410; 434/11, 16, 19, 23
See application file for complete search history.

(56) References Cited

U.S. PATENT DOCUMENTS 1,223,290 A * 4/1917 Ravenshear ..... 273/409
2,090,930 A * 8/1937 Chubb ..... 273/408
4,508,508 A * 4/1985 Theodore ..... 434/19
5,593,162 A * 1/1997 Minuskin ..... 273/403
5,669,610 A * 9/1997 Salyers ..... 273/407
2004/0046321 A1* 3/2004 Karnofsky ..... 273/409

* cited by examiner

*Primary Examiner*—Mark S. Graham
(74) *Attorney, Agent, or Firm*—Thomas B. Tate

(57) ABSTRACT

A weapons qualification target having indicia thereon, including a photograph of a human being, a drawing of selected parts of the human anatomy, and a standard weapons qualification scoring pattern. The scoring pattern and the anatomical indicia are invisible from the usual firing distance for weapons qualification so that the shooter sees a realistic target when qualifying.

1 Claim, 1 Drawing Sheet

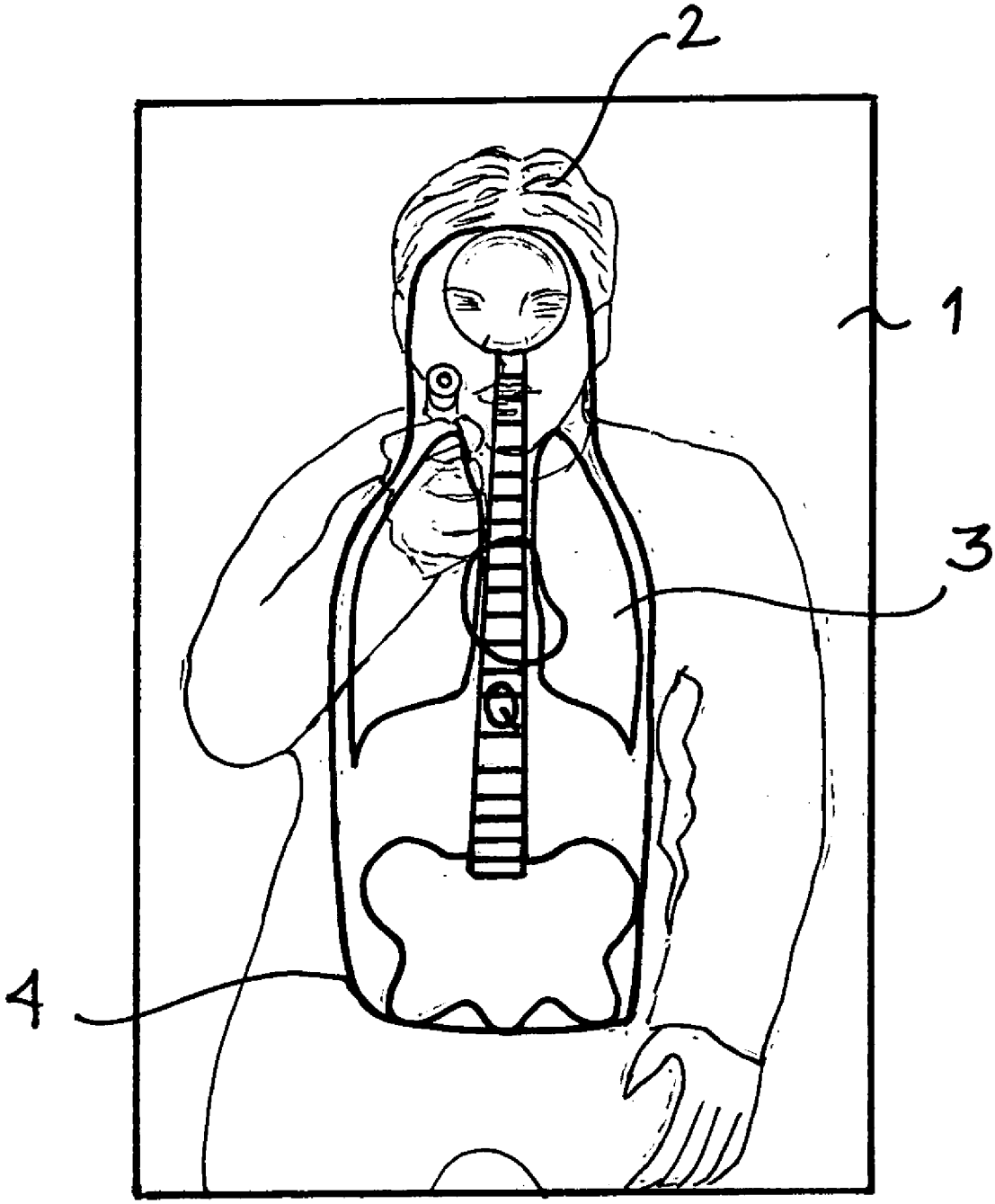
2
1
3
4

ANATOMICAL WEAPONS QUALIFICATION TARGET

BACKGROUND OF THE INVENTION

The field of the invention is targets used for practicing shooting skills, and more particularly, targets used by law enforcement agencies for weapons qualification training.

Federal, state, and local law enforcement agencies require their personnel to undergo weapons qualification testing as part of their initial training and periodically thereafter to maintain their skills. Targets used for weapons qualification have a standardized scoring pattern on them, outlining the area within which an officer must land a predetermined percentage of his or her shots in order to pass the test. Different agencies use different scoring patterns. The target is usually set up at least seven yards (twenty-one feet) from the firing line.

My company, Law Enforcement Targets, Inc., makes some targets that have a photograph of a human being in addition to a standardized scoring pattern. The only known example of a target that includes anatomical features is shown in U.S. Pat. No. 4,508,508 to Theodore, which has the anatomical features on the reverse side of the target. No known prior art combines a photograph of a human, a standardized scoring pattern, and anatomical features, the latter two features being invisible from the standard firing distance.

SUMMARY OF THE INVENTION

The invention is a weapons qualification target that includes a photograph of a human, key anatomical features shown in their actual typical locations, and a standardized scoring pattern, the latter two features being invisible from a distance of seven yards or more.

An advantage of the invention is that it provides law enforcement personnel with more realistic weapons training. The officer firing at the target sees a person as he or she would appear in real life, and learns to aim not only in the area needed to pass the test, but also learns what organs or skeletal structures he or she would hit on an actual human. Usually an officer will try to shoot an uncooperative suspect in an area where the suspect will be sufficiently incapacitated to allow him or her to be arrested, but the suspect will recover from the wound. On rare occasions, the officer will aim to kill the suspect when necessary to protect the lives of the arresting officers or innocent bystanders.

DESCRIPTION OF THE DRAWING

The FIGURE is a front view.

DETAILED DESCRIPTION OF THE INVENTION

The target is a flat sheet 1 of paper, cardboard, or other suitable materials. At least the following indicia are included on the target: a photographic representation 2 of a human being, a representation 3 of selected internal anatomical structures of a human being, and a standardized scoring pattern 4. Normally the target will be set up at least seven yards from the firing line for weapons qualification, and may be attached to any suitable support means.

The photographic representation 2 of a human may be either a black and white or color photograph. The photograph should preferably be taken under natural lighting conditions. Usually the photograph will be blown up to a life-size representation 2 of an average size person. However, smaller than life-size photographs may be used if, for example, it is desired to simulate firing at a suspect from a greater distance without actually increasing the distance between the firing line and the target.

Selected internal anatomical structures 3 of a human being are drawn onto the photograph 2 of a human being, and are positioned in the locations where these anatomical structures would typically be found on an average human being. The anatomical structures 3 shown in the FIGURE are the brain, spinal cord, lungs, heart, and pelvis, which are the major vital organs and skeletal structures that lie within the outline of most standardized scoring patterns. This is, however, only an example, as additional or different anatomical structures could be shown. The anatomical structures 3 may be drawn onto the photograph 2 either manually or by using a computer drawing program such as Adobe Photo Shop.

A standardized scoring pattern 4 is superimposed on the photograph 2 so that the anatomical structures 3 are within the outline of the scoring pattern 4. The example shown in the FIGURE is an FBI-Q pattern, but any standardized scoring pattern could be used. A non-comprehensive list of standardized scoring patterns currently used by law enforcement agencies includes: FBI-Q, DEA-Q, QIT, QIT-97, QIT-99, QIT-03, B-27, TQ-19, TQ-21, TQ-15, TQ-16, TQ-22, SEB, M9, IPSC, USFWS-KCF-1, IALEFI-Q, TRANSTAR-I, TRANSTAR-II, TRANSTAR III, B-21×, B-21E, DOE-15, NM-DPS4S, and LA-P 1.

Other indicia could be included on the target as optional features. For example, a sighting circle used for zeroing weapons before beginning qualification shooting is a common feature on weapons qualifications targets and could be used on these targets.

In order to provide more realistic weapons qualification testing, the anatomical structures 3 and the standardized scoring pattern 4 are drawn so that they are invisible to a person standing seven yards or more away from the target. Thus, while standing at the minimum standard weapons qualification distance of seven yards, the shooter will see only the photograph 2, as he or she would see a suspect in real life. The anatomical structures 3 and the scoring pattern 4 are made invisible, either manually or by a computer drawing program, by knocking out both the scoring pattern 4 and the anatomy lines 3 from the photograph halftone and then screening them back with a percentage shade of the original color of the photograph 2. On a black and white photograph, screen in the target line by making shades of gray on the target line that are close to the shade of gray on the person in the photograph 2. Similarly, on a color photograph, shades are screened in that are similar enough to the original colors of the photograph 2 that the human eye cannot distinguish the shades at the standard weapons qualification distance.

I claim:

1. A weapons qualification target having on the front side thereof at least the following indicia thereon:

a photographic representation of a human being;

representations of selected anatomical structures of a human being, said anatomical structures being positioned on said photographic representation of a human being in the locations where said anatomical structures would typically be found on an average human being;

and a standardized scoring pattern used for weapons qualification;

wherein said representations of internal anatomical structures and said standardized scoring pattern are invisible to a person standing seven yards or more away from said target, said representations of said internal anatomical structures and said standardized scoring pattern being made invisible by knocking out both said scoring pattern and said representations of said anatomical structures from the photograph halftone and then screening said scoring pattern and said representations of anatomical structures back with a percentage shade of the original color of said photograph.

* * * * *